US006832499B2

(12) United States Patent
Stillwagon

(10) Patent No.: US 6,832,499 B2
(45) Date of Patent: Dec. 21, 2004

(54) VANDAL RESISTANT T-HANDLE ASSEMBLY

(75) Inventor: Woodrow C. Stillwagon, Atlanta, GA (US)

(73) Assignee: Star Lock Systems, Inc., Hilliard, OH (US)

( * ) Notice: Subject to any disclaimer, the term of this patent is extended or adjusted under 35 U.S.C. 154(b) by 17 days.

(21) Appl. No.: 10/455,602

(22) Filed: Jun. 5, 2003

(65) Prior Publication Data

US 2003/0200776 A1 Oct. 30, 2003

Related U.S. Application Data

(63) Continuation-in-part of application No. 10/420,646, filed on Apr. 22, 2003, now abandoned, which is a continuation of application No. 09/928,384, filed on Aug. 13, 2001, now Pat. No. 6,564,597.

(60) Provisional application No. 60/224,884, filed on Aug. 14, 2000.

(51) Int. Cl.[7] ..... E05B 13/10

(52) U.S. Cl. ..... 70/208; 70/224; 70/417; 292/336.3

(58) Field of Search ..... 70/208, 224, 417, 70/207, 221, 215–217, DIG. 31; 292/336.3, 347, DIG. 31

(56) References Cited

U.S. PATENT DOCUMENTS

| | | | | |
|---|---|---|---|---|
| 685,188 | A | 10/1901 | Taylor | 70/418 |
| 770,408 | A | 9/1904 | Wells | 70/418 |
| 977,085 | A | 11/1910 | Eras | 70/417 |
| 1,140,209 | A | 5/1915 | Taylor | 70/417 |
| 1,228,445 | A | 6/1917 | Janes | 70/417 |
| 1,853,564 | A | 4/1932 | Jacobi | 70/208 X |
| 2,268,766 | A | 1/1942 | Monroe | 292/346 X |
| 2,378,837 | A | 6/1945 | Cohan | 292/346 |
| 3,089,329 | A | 5/1963 | Kerr | 70/135 |
| 3,089,330 | A | 5/1963 | Kerr | 70/208 |
| 3,122,012 | A | 2/1964 | Christopher | 70/140 |
| 3,213,654 | A | 10/1965 | Dauenbaugh et al. | 70/208 |
| 3,222,899 | A | 12/1965 | Bodoh et al. | 70/140 |
| 3,302,434 | A | 2/1967 | Dauenbaugh et al. | 70/208 |
| 3,316,742 | A | 5/1967 | Wellekens | 70/418 |
| 3,438,227 | A | 4/1969 | Wolniak | 70/208 |
| 3,550,412 | A | 12/1970 | Pitel et al. | 70/208 |
| 3,738,134 | A | 6/1973 | Hall | 70/86 |
| 3,768,284 | A | 10/1973 | Kent et al. | 70/104 |
| 3,834,198 | A | 9/1974 | Wiczer | 70/208 |
| 3,911,534 | A | 10/1975 | Martens et al. | 24/150 R |
| 4,132,092 | A | 1/1979 | Steinbach | 70/208 |
| 4,221,025 | A | 9/1980 | Martens et al. | 24/150 R |
| 4,476,699 | A | 10/1984 | Dahlborg | 70/34 |
| 4,530,223 | A | 7/1985 | Oliver | 70/417 |
| 4,552,001 | A | 11/1985 | Roop | 70/208 |
| 4,611,477 | A | 9/1986 | Crites | 70/418 X |
| 4,716,749 | A | 1/1988 | Johnson | 70/363 |
| 4,760,721 | A | 8/1988 | Steinbach | 70/208 |
| 4,835,998 | A | 6/1989 | Steinbach | 70/208 |
| 4,838,055 | A | 6/1989 | Gallagher | 70/208 |
| 4,899,561 | A | 2/1990 | Myers | 70/208 |
| 4,993,247 | A | 2/1991 | Minemura | 70/208 |

(List continued on next page.)

FOREIGN PATENT DOCUMENTS

| | | |
|---|---|---|
| AU | 14019 | 8/1933 |
| GB | 6783 | 3/1912 |

*Primary Examiner*—Lloyd A. Gall
(74) *Attorney, Agent, or Firm*—Womble Carlyle Sandridge & Rice, PLLC

(57) ABSTRACT

The present invention discloses a vandal resistant coupled T-handle assembly for a T-handle locking assembly commonly used in vending machines. The coupled T-handle assembly comprises a hardened sleeve secured over a face element of the T-handle assembly. The hardened sleeve is formed from a tamper resistant, high strength material capable of resisting attempts by thieves and vandals to gain access to interior compartments of a vending machine by drilling through, battering or otherwise destroying the face element of the T-handle assembly and thereafter breaking the locking assembly. The T-handle assembly also includes additional lock holes at the base of the T-handle body to provide additional element passages for increased security.

11 Claims, 14 Drawing Sheets

U.S. PATENT DOCUMENTS

| | | | | |
|---|---|---|---|---|
| 5,010,745 | A | 4/1991 | Hall et al. | 70/32 |
| 5,022,243 | A | 6/1991 | Embry et al. | 70/34 |
| 5,027,630 | A | 7/1991 | Stillwagon et al. | 70/391 |
| 5,038,588 | A | 8/1991 | Hall | 70/208 |
| 5,197,314 | A | 3/1993 | Stillwagon et al. | 70/386 |
| 5,212,972 | A | 5/1993 | Kincaid et al. | 70/208 |
| 5,269,161 | A | 12/1993 | Stillwagon et al. | 70/34 |
| 5,272,894 | A | 12/1993 | Stillwagon et al. | 70/208 |
| 5,467,619 | A | 11/1995 | Stillwagon et al. | 70/34 |
| 5,711,506 | A | 1/1998 | Stillwagon | 70/208 |
| 5,921,119 | A | 7/1999 | Myers et al. | 70/208 |
| 6,345,522 | B1 | 2/2002 | Stillwagon et al. | 70/277 |
| 6,422,049 | B1 | 7/2002 | Jenks | 70/208 |
| 6,564,597 | B1 * | 5/2003 | Stillwagon | 70/208 |
| 2002/0078722 | A1 | 6/2002 | Corey | 70/208 |

* cited by examiner

VANDAL RESISTANT T-HANDLE ASSEMBLY

CROSS-REFERENCES TO RELATED APPLICATIONS

This application is a continuation-in-part of application Ser. No. 10/420,646, filed Apr. 22, 2003 now abandoned; which application is a continuation of application Ser. No. 09/928,384, filed Aug. 13, 2001, now U.S. Pat. No. 6,564,597; which application claims the benefit of U.S. provisional application Ser. No. 60/224,884, filed on Aug. 14, 2000.

BACKGROUND OF THE INVENTION

Vending machines often include T-handle locking assemblies for locking and unlocking the outer door of the vending machine to prevent unauthorized access to its interior compartments. A traditional T-Handle is shown in prior art FIGS. 1 and 2. Such a T-handle 1 generally comprises a substantially rectangular outer handle or face element 10 and an elongated, cylindrical lock housing or T-handle body 20. One end of the body 20 is attached to the face element 10, forming a "T" shape, while the opposite end of the body typically includes a passage 23 for receiving a threaded lock stud that allows the T-handle to screw into a threaded aperture in the door frame of the enclosure to tighten and secure the door against the enclosure. The T-handle body generally has a hollow interior that houses a plug lock and locking bolt elements actuated by a key inserted into the lock, and further includes a shallow locking bolt element passage 21 and a deep locking bolt element passage 22. The face element generally includes a plug lock passage or opening 11 aligned with the interior of the T-handle body 20 to provide access to the lock.

In use for securing an enclosure door, the T-handle generally is secured by screwing the T-handle 1 into the threaded aperture to secure the door, after which the T-handle is urged against a biasing force of a biasing spring, such that the T-handle 1 becomes recessed in the door of the vending machine or enclosure. The lock then is engaged so that the locking bolt element protrudes through one of the locking bolt element passages 21 or 22 and engages a retention ledge in an outer housing of the locking assembly. The engagement of the locking bolt element with the retention ledge thus locks and holds the T-handle 1 in the recessed position. The T-handle 1 is typically unlocked by first unlocking the plug lock that causes the locking bolt element to be disengaged from the retention ledge. As the locking bolt element is released, the biasing force of the spring causes the T-handle 1 to pop out from the door of the vending machine or enclosure, enabling the T-handle 1 to be rotated and thus unscrewed from the threaded aperture to allow the enclosure door to be opened.

A significant problem with conventional T-handles, which are typically made of softer metal materials, such as zinc, is that they generally can easily be drilled, battered or otherwise destroyed. Thieves and vandals have been known to gain access to a vending machine by simply drilling through the face element of a T-handle to remove the retention ledge of the locking assembly and overcome the security provided by the T-handle, thus enabling the vending machine door to be opened. Thieves and vandals have also been known to use a "puller" tools such as crow-bars or pry bars, as well as high impact tools like hammers, sledgehammers, and simple bats or similar objects to break T-handles and gain access to the interior of the vending machines.

Accordingly, it can be seen that a need exists for an improved locking system for use with enclosures that addresses these and other related problems in the art.

SUMMARY OF THE INVENTION

The present invention generally relates to a vandal resistant T-handle assembly for T-handle locking assemblies such as are used to secure interior compartments of vending machines or other enclosures. The vandal resistant T-handle assembly is designed to prevent vandals and thieves from drilling through the T-handle assembly, breaking the T-handle assembly with "puller" tools and/or destroying the T-handle assembly with high-impact tools such as hammers. The T-handle assembly of the present invention further is designed for new systems as well as be used to retrofit late model T-handle locking assemblies such as the T-handle locking assembly manufactured by the Chicago Lock Company and protected by U.S. Pat. No. 4,760,721.

The T-handle assembly of the present invention generally includes a die-cast T-handle body, a die-cast face element and a tamper resistant back plate coupled to the face element. The back plate is constructed of a hardened metal, such as steel, or other similar materials of comparable high strength and hardness, and generally includes edge stiffeners that reinforce the periphery of the face element to protect against drilling through the face element, bending by a puller tool, and/or strikes by a high-impact tool. According to one embodiment of the invention, the face element further can include rounded edges that resist gripping by puller tools.

Another embodiment of the present invention provides a hardened sleeve to further secure T-handle assembly and prohibit drilling through the T-handle face. Although a hardened back plate such as utilized in other embodiments herein also operates as an effective vandal deterrent, such a partially drilled hole detracts from the appearance of the T-handle. The addition of the hardened steel sleeve will assist in helping to stop the vandal at the surface of the T-handle and help to prevent an unsightly vandalized closure element.

Various objects, features and advantages of the invention will be apparent to those of skill in the art upon reading the following detailed description, when taken in conjunction with the accompanying drawings.

BRIEF DESCRIPTION OF THE DRAWINGS

FIG. 21 *a* shows an, edge view of the hardened sleeve of FIG. 20 with a face element slot.

DETAILED DESCRIPTION OF THE INVENTION

The present invention discloses a vandal resistant T-handle assembly for a T-handle. locking assembly in a vending machine or similar enclosure to provide improved security against attempts of vandals and thieves to gain unauthorized access to enclosures secured by T-handle locking assemblies. The T-handle assembly of the present invention is designed for use in new design locking assemblies as well as for use as a retro-fit to currently used T-handle locking assemblies without requiring redesign or reconfiguration of the existing lock housing and locking mechanism.

FIGS. 3–9 show a vandal resistant T-handle assembly 100 according to one embodiment of the present invention. The T-handle assembly 100 includes a face element 110, a T-handle body 120 and a tamper resistant back plate 130. The face element 110 and T-handle body 120 generally are formed from a metal such as steel, aluminum, zinc or other metals, or can be formed from a composite material, and can be die-cast or stamped to form a one-piece face element and body unit, or can be formed from separate pieces or sections that can be joined together such as by welding or other attachments. The features and elements T-handle assembly 100 will now be described in detail.

Figure 1:
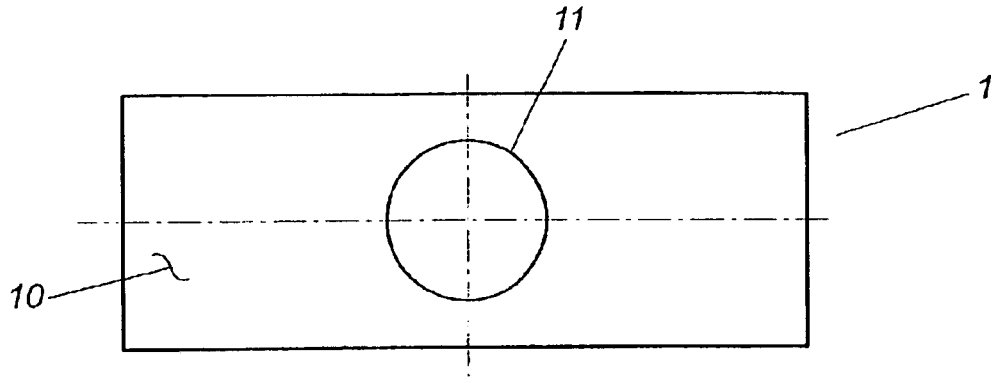
Fig. 1 (Prior Art)
FIG. 1 shows a front view of a prior art T-handle.
Figure 2:
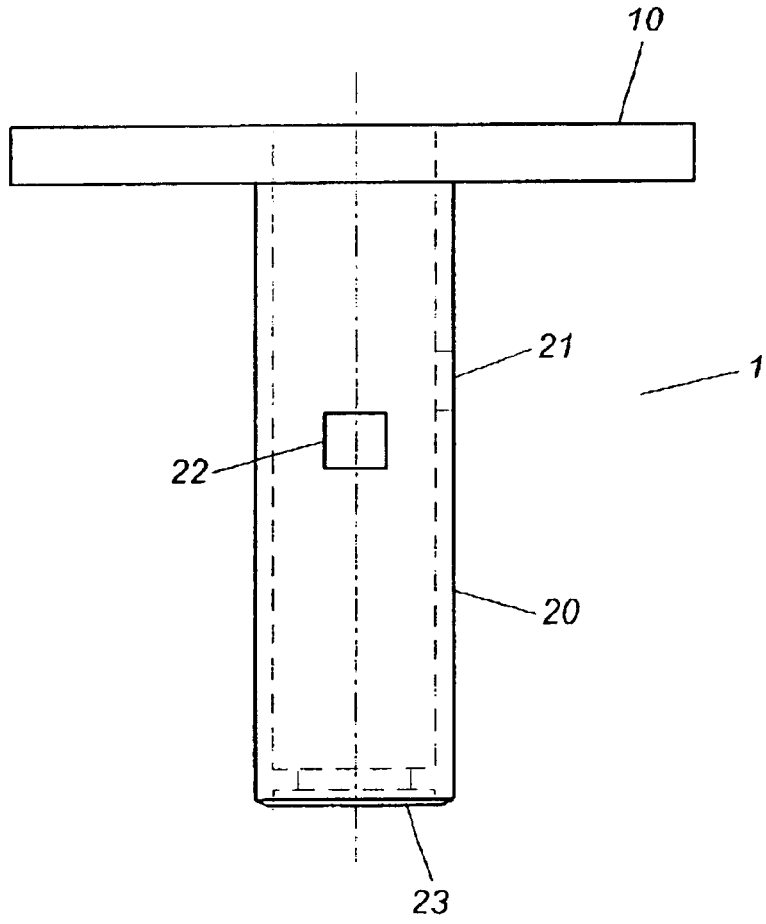
Fig. 2 (Prior Art)
FIG. 2 shows a side view of a prior art T-handle.
Figure 3:
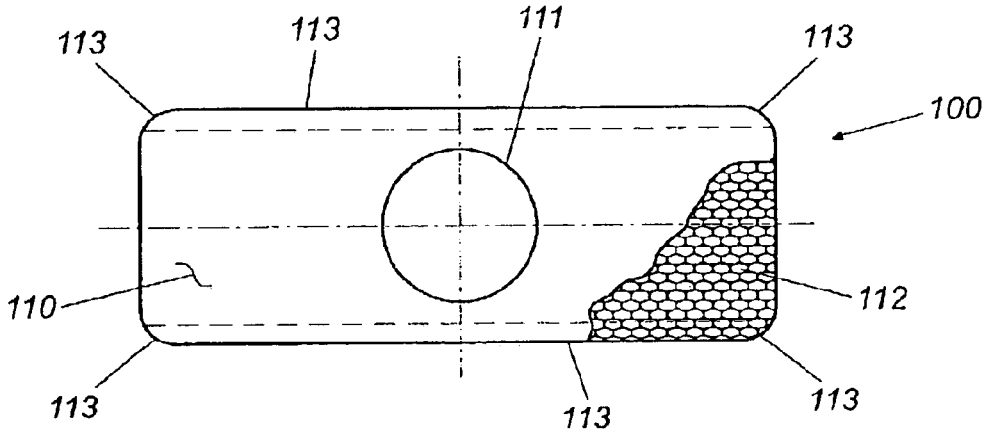
FIG. 3 shows a front view of a vandal resistant T-handle assembly according to one embodiment of the present invention.

As shown in FIG. 3, face element 110 generally includes a plug lock passage 111, a textured front face or first surface 112 with rounded edges 113, and a rear face or second surface 114 (FIG. 9) having tubular, rivet-like protrusions 115 and having a recessed middle portion 118. The recessed middle portion 118 includes ledges 119 at the top and bottom extremities of the rear face. The protrusions 115 and ledges 119 are provided for securing the back plate to the face element 110.

Figure 4:
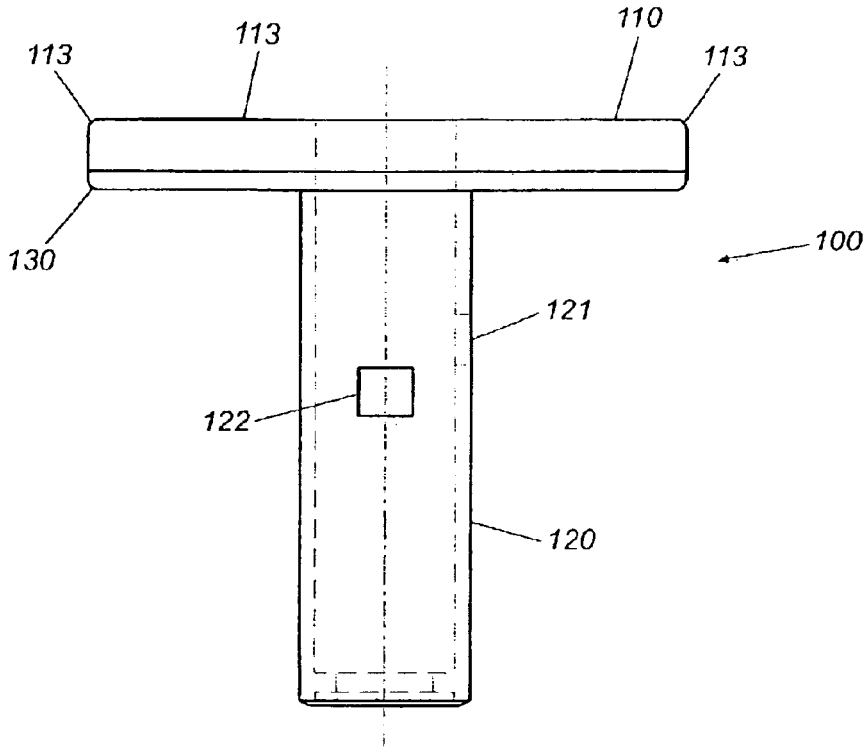
FIG. 4 shows a side view of the vandal resistant T-handle assembly of FIG. 3.
Figure 5:
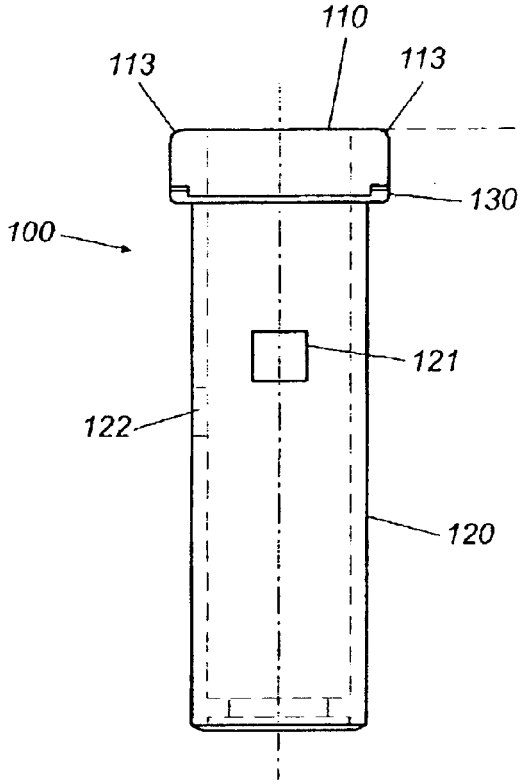
FIG. 5 shows a top view of the vandal resistant T-handle assembly of FIG. 3.
Figure 6:
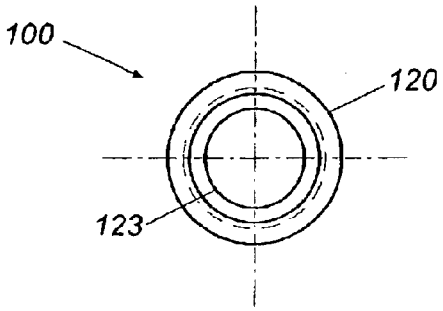
FIG. 6 shows an end view of a T-handle body of the vandal resistant T-handle assembly of FIG. 3.
Figure 7:
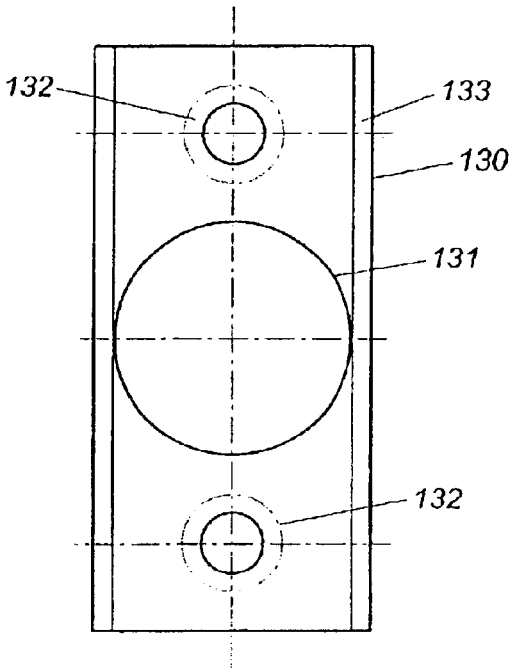
FIG. 7 shows a back plate of the vandal resistant T-handle assembly of FIG. 3.
Figure 8:
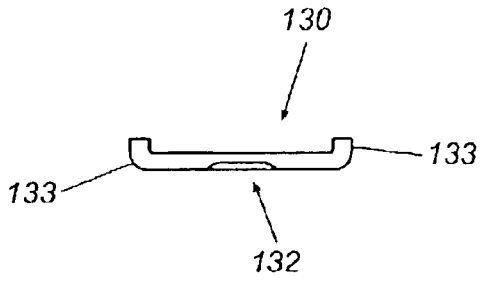
FIG. 8 shows an edge view of the back plate of FIG. 7.
Figure 9:
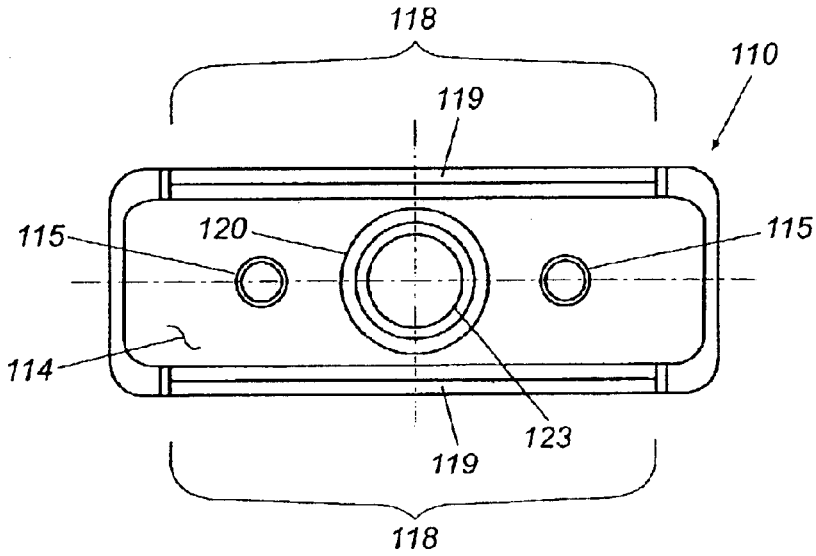
FIG. 9 shows a rear view of the vandal resistant T-handle assembly of FIG. 3.

The T-handle body 120 is shown in FIGS. 4–6, and generally includes a first or shallow locking bolt element passage 121 and a second or deep locking bolt element passage 122. The T-handle body 120 further includes a threaded lock stud passage 123, shown in FIG. 6, for accommodating a threaded lock stud enabling rotation of the T-handle assembly 100 into a recessed, locked position within the door of a vending machine or a similar enclosure.

FIGS. 4, 5, 7 and 8 show the back plate 130 of the T-handle assembly 100. Back plate 130 preferably is constructed of a high strength, tamper resistant, hardened, drill resistant metal material, such as steel, but may also be constructed from other, similar materials, including composites, having a comparable high strength and hardness. As further shown in FIGS. 4 and 5, the back plate 130 generally is coupled to the rear face 114 of the face element 110, and includes a T-handle body passage 131 (FIG. 7) and mounting holes 132 for coupling the back plate 130 to the rear face 114 of face element 110. The back plate 130 further includes rounded edge stiffeners 133, shown in FIG. 8, to reinforce the periphery of the face element and to resist bending of the back plate.

The T-handle assembly 100 generally is assembled for use in a T-handle locking assembly by coupling the back plate 130 to the face element 110, and more specifically, by coupling or mounting the back plate 130 to the rear face 114 of face element 110 as shown in FIGS. 4 and 5. This attachment typically is accomplished by first passing the T-handle body 120 through the T-handle body passage 131 of the back plate 130, and then aligning and arranging the mounting holes 132 over the protrusions 115. Thereafter, the back plate 130 is mated to the rear face 114 by aligning the back plate 130 within the recessed area 118 of the rear face 114 and engaging the ledges 119 and recessed portions 118 of the face element 110 with the edge stiffeners 133 of back plate 130. Thereafter, the back plate 130 generally is secured to the rear face 114 by urging or moving the protrusions 115 down over the mounting holes 132. This may be done using a spinner tool to apply pressure and rotational force to the protrusions 115, causing the protrusions 115 to form rivets. Although it is preferable to secure the back plate 130 to rear face 114 using the protrusions 115 and mounting holes 132, other acceptable coupling elements and methods may be used in addition to or in place of the elements and methods described above.

Figure 3A:
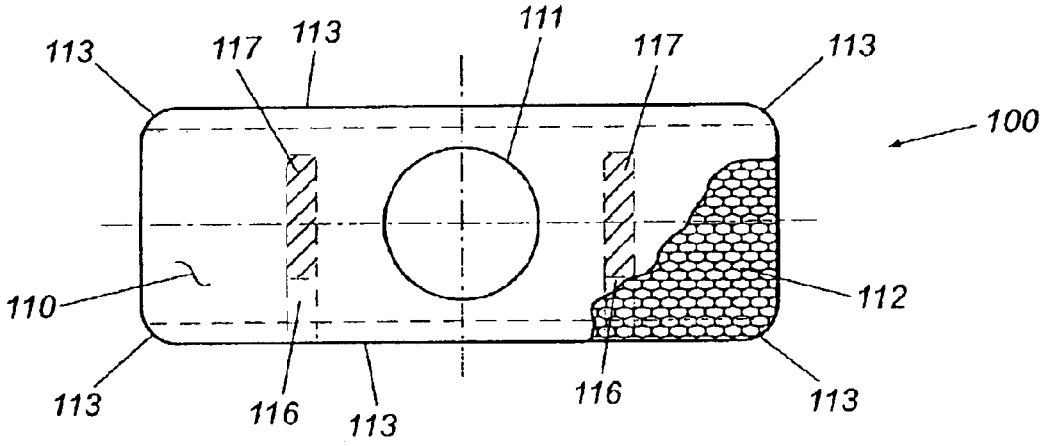
FIG. 3*a* shows a front view of the vandal resistant T-handle assembly of FIG. 3 including optional drill resistant pins.
Figure 4A:
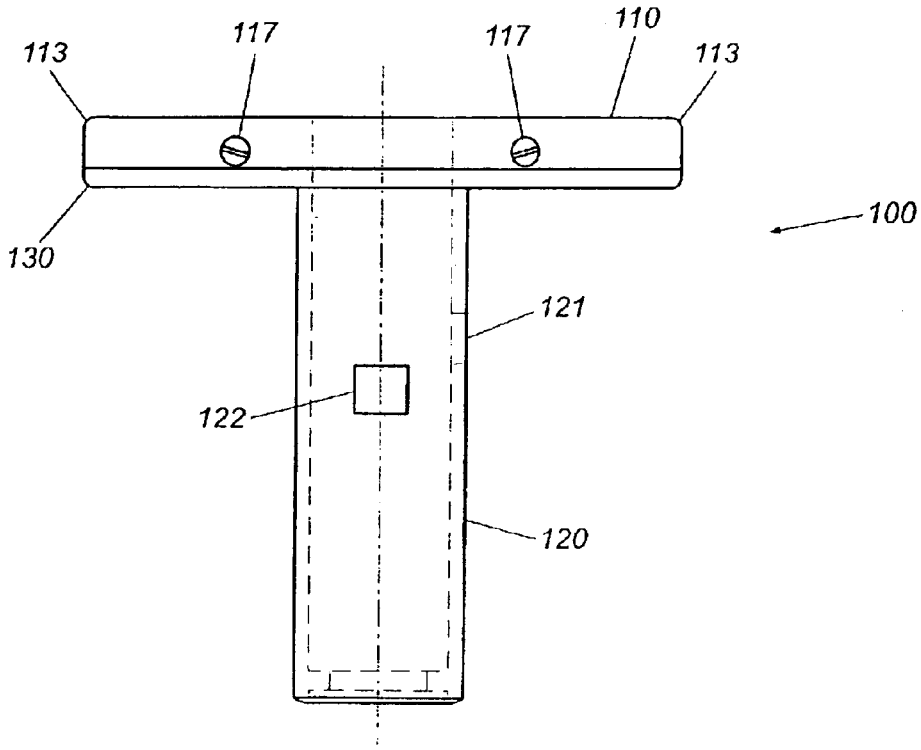
FIG. 4*a* shows a side view of the vandal resistant T-handle assembly of FIG. 3 including optional drill resistant pins.
Figure 5A:
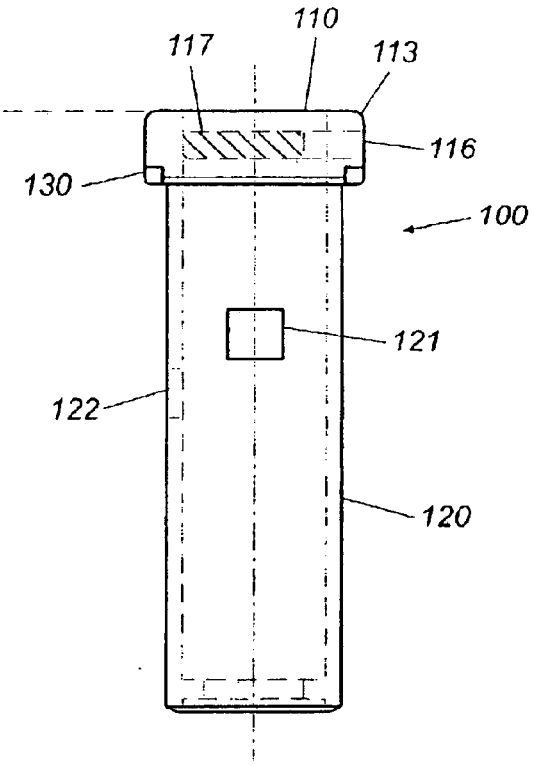
FIG. 5*a* shows a top view of the vandal resistant T-handle assembly of FIG. 3 including optional drill resistant pins.

Optionally, as shown in FIGS. 3*a*, 4*a* and 5*a*, face element 110 includes drill resistant pins 117 in front of the protrusions 115 to further enhance the security of the T-handle assembly 100. Blind pin holes 116 are provided in the face element 110 to allow for the pins 117 to be included within the face element. The pin holes 116 may be cast into face element 110, or they may be drilled into the face element 110 after casting the face element 110. The drill resistant pins 117 are inserted into the blind pin holes 116. Once the pins 117 have been inserted into the blind pin holes 116, they cannot be removed by a thief or vandal. The drill resistant pins 117 add heightened protection against vandalism and theft, as they prevent thieves and vandals from drilling out the protrusions 115 to remove the tamper resistant back plate 130 from the rear face 114 of face element 110.

Vandals and thieves have been known to drill through the face element of a T-handle in order to break the T-handle and T-handle locking assembly. Vandals and thieves have also been known to batter a T-handle with a high-impact tool and to pull on a T-handle with a puller tool having a vice-like gripping mechanism in order to fracture the T-handle body and break the locking assembly. The tamper resistant back plate 130 enables the T-handle assembly 100 to resist penetration by drills as well as bending and breaking by high impact tools. When the T-handle assembly 100 is secured within the enclosure door in a locked position, the rounded edges 113 of the face element are the only parts of the T-handle assembly that protrude from the outside surface of the door. The rounded edges 113 add further security to the T-handle assembly 100 by resisting gripping by puller tools.

Another embodiment of the vandal-resistant T-handle assembly 200 of the invention is shown in FIGS. 10–13. The T-handle assembly 200 includes a face element 210, a T-handle body 220 and a tamper resistant back plate 230. The face element 210 and T-handle body 220 are formed in the same manner as T-handle assembly 100 in the embodiment of FIGS. 3–9. With the exception of the face element 210, the T-handle assembly 200 includes the same features as T-handle assembly 100 of the previous embodiment.

Figure 10:
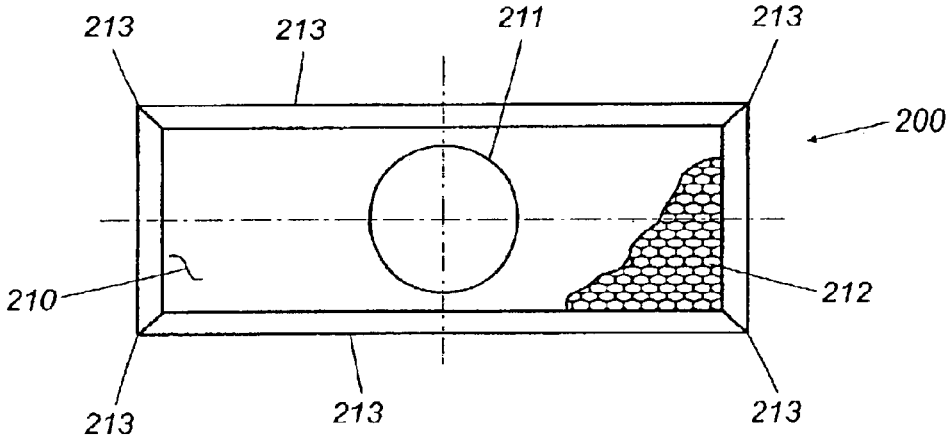
FIG. 10 shows a front view of a vandal resistant T-handle assembly according to another embodiment of the invention.

As shown in FIG. 10, face element 210 generally includes a plug lock passage 211, a textured front face or first surface 212 with beveled edges 213, and a rear face or second surface 214 (FIG. 13) having tubular, rivet-like protrusions 215 and having a recessed middle portion 218. The recessed middle portion 218 includes ledges 219 at the top and bottom extremities of the rear face. The protrusions 215 and ledges 219 are provided for securing the back plate to the face element 210.

Figure 11:
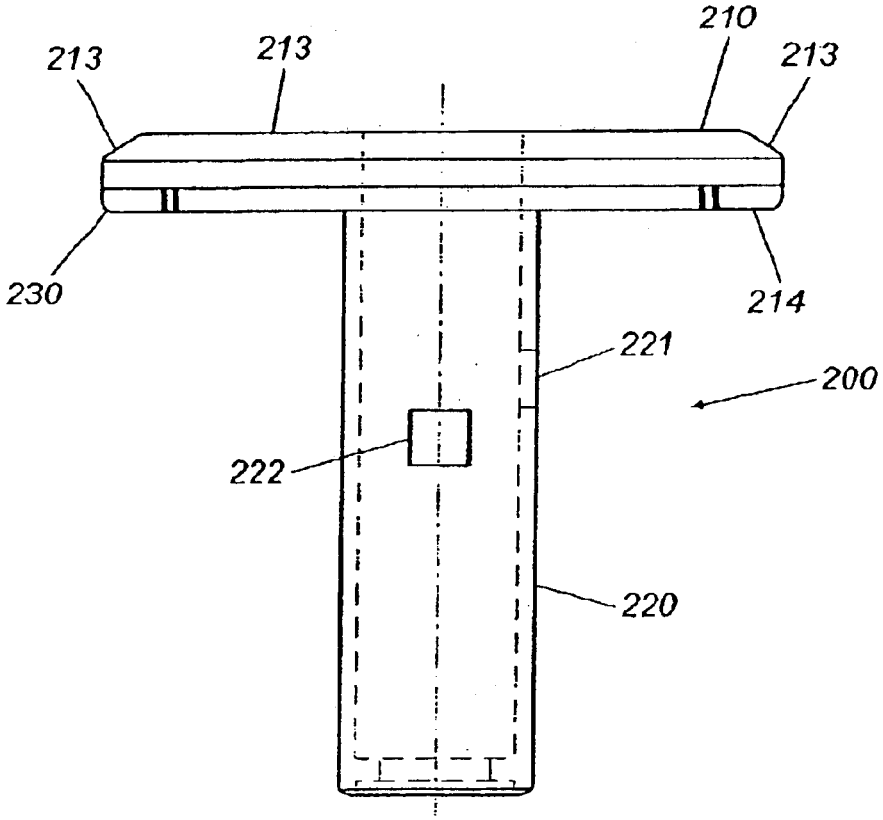
FIG. 11 shows a side view of the vandal resistant T-handle assembly of FIG. 10.

The T-handle body 220 is shown in FIG. 11, and generally includes a first or shallow locking bolt element passage 221 and a second or deep locking bolt element passage 222. The T-handle body 220 further includes a threaded lock stud passage 223 for accommodating a threaded lock stud enabling rotation of the T-handle assembly 200 into a recessed, locked position within the door of a vending machine or a similar enclosure.

Figure 12:
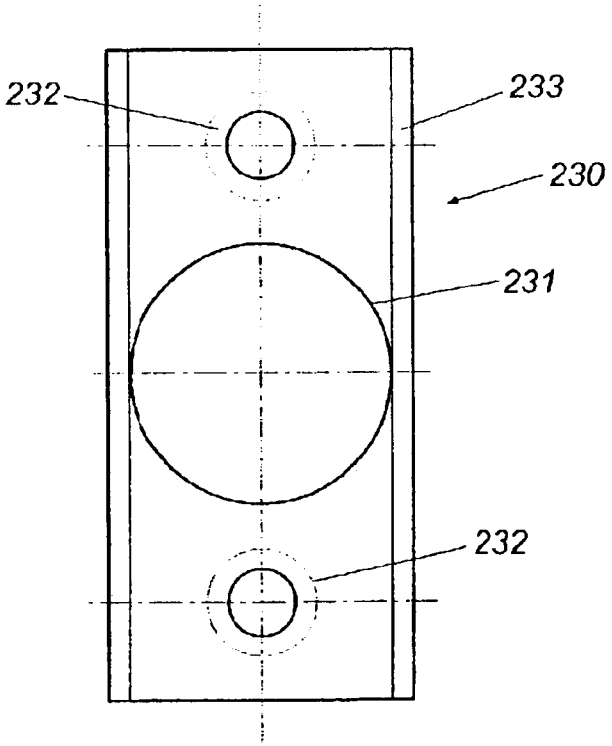
FIG. 12 shows a back plate of the vandal resistant T-handle assembly of FIG. 10.
Figure 13:
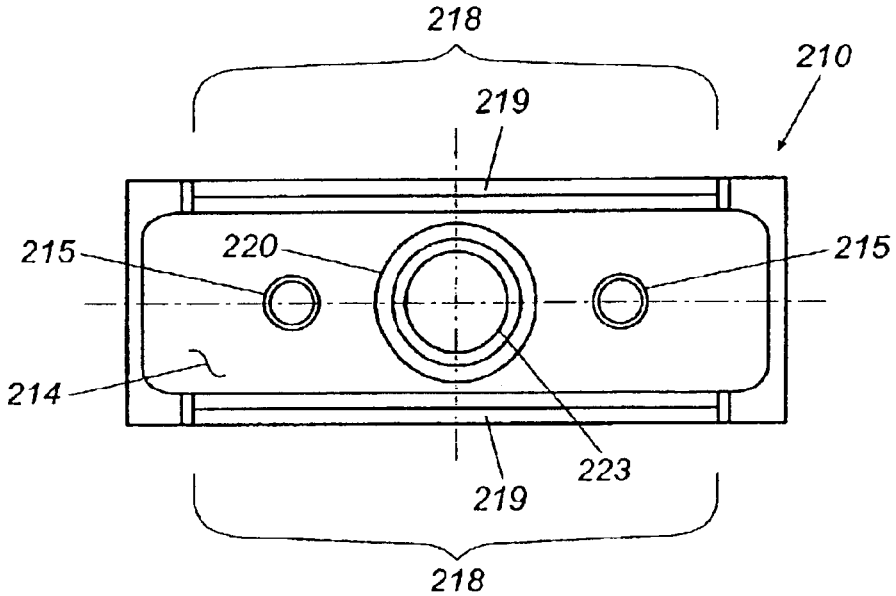
FIG. 13 shows a rear view of the vandal resistant T-handle assembly of FIG. 10.

FIGS. 11 and 12 show the back plate 230 of the T-handle assembly 200. As with the back plate of the previous embodiment, back plate 230 preferably is constructed of a high strength, tamper resistant, hardened, drill resistant metal material, such as steel, but may also be constructed from other, similar materials, including composites, having a comparable high strength and hardness. As shown in FIG. 11, the back plate 230 generally is coupled to the rear face 214 of the face element 210, and includes a T-handle body passage 231 (FIG. 12) and mounting holes 232 for coupling the back plate 230 to the rear face 214 of face element 210. The back plate 230 further includes rounded edge stiffeners 233 to reinforce the periphery of the face element and to resist bending of the back plate.

The T-handle assembly 200 is assembled for use in a T-handle locking assembly in the same manner as T-handle assembly 100 is assembled. That is, T-handle assembly 200 is assembled by coupling the back plate 230 to the face element 210, and more specifically, by coupling or mounting the back plate 230 to the rear face 214 of face element 210 as shown in FIG. 11. This attachment typically is accomplished by first passing the T-handle body 220 through the T-handle body passage 231 of the back plate 230, and then aligning and arranging the mounting holes 232 over the protrusions 215. Thereafter, the back plate 230 is mated to the rear face 214 by aligning the back plate 230 within the recessed area 218 of the rear face 214 and engaging the ledges 219 and recessed portions 218 of the face element 210 with the edge stiffeners 233 of back plate 230. Thereafter, the back plate 230 generally is secured to the rear face 214 by urging or moving the protrusions 215 down over the mounting holes 232. As in the previous embodiment, this may be done using a spinner tool.

Figure 10A:
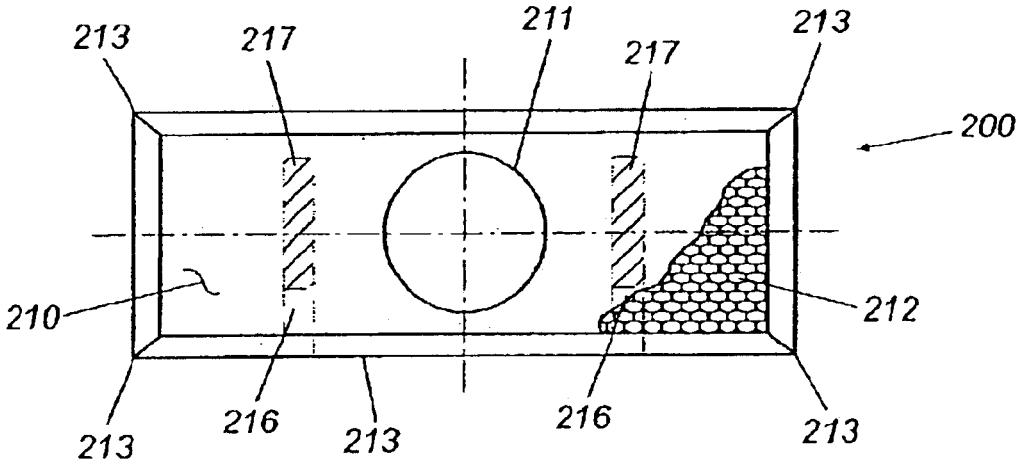
FIG. 10*a* shows a front view of the vandal resistant T-handle assembly of FIG. 10 including optional drill resistant pins.

As shown in FIG. 10*a*, the face element 210 optionally includes drill resistant pins 217 in front of the protrusions 215. To allow for the inclusion of the pins 217, blind pin holes 216 are provided in the face element 210. The pin holes 216 may be cast into face element 210, or they may be drilled into the face element 210 after casting the face element 210. The drill resistant pins 217 are inserted into the blind pin holes 216.

The vandal resistant T-handle assembly 200 resists tampering by vandals, as it includes many of the features of vandal resistant T-handle assembly 100. The T-handle assembly 200 lacks rounded outer edges and is therefore not as effective against puller tools as is T-handle assembly 100. However, the beveled outer edges 213 of T-handle assembly 200 can meet the different appearance needs of a particular user.

FIGS. 14–17 show T-handle assembly 300, which is yet another embodiment of the invention. The T-handle assembly 300 includes a face element 310, a T-handle body 320 and a tamper resistant back plate 330. The face element 310 and T-handle body 320 are formed in the same manner as the T-handle assemblies of the previous embodiments. With the exception of the face element 310, the T-handle assembly 300 includes the same features as T-handle assemblies 100 and 200 of the previous embodiments.

Figure 14:
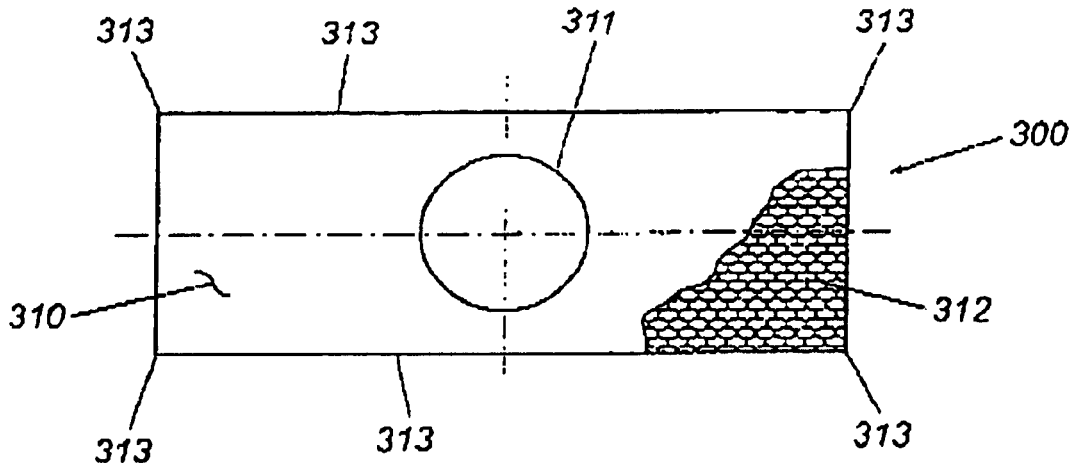
FIG. 14 shows a front view of a vandal resistant T-handle assembly according to yet another embodiment of the invention.
Figure 17:
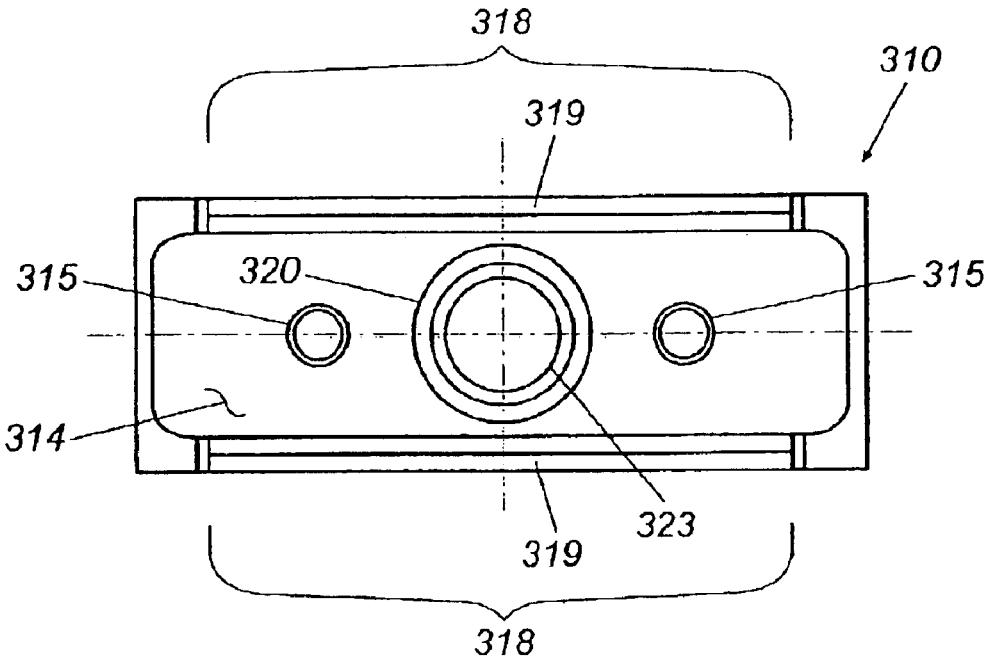
FIG. 17 shows a rear view of the vandal resistant T-handle assembly of FIG. 14.

As shown in FIG. 14, face element 310 generally includes a plug lock passage 311, a textured front face or first surface 312 with square edges 313, and a rear face or second surface 314 (FIG. 17). The rear face 314 has tubular, rivet-like protrusions 315 and a recessed middle portion 318. The recessed middle portion 318 includes ledges 319 at the top and bottom extremities of the rear face. The protrusions 315 and ledges 319 are provided for securing the back plate to the face element 310.

Figure 15:
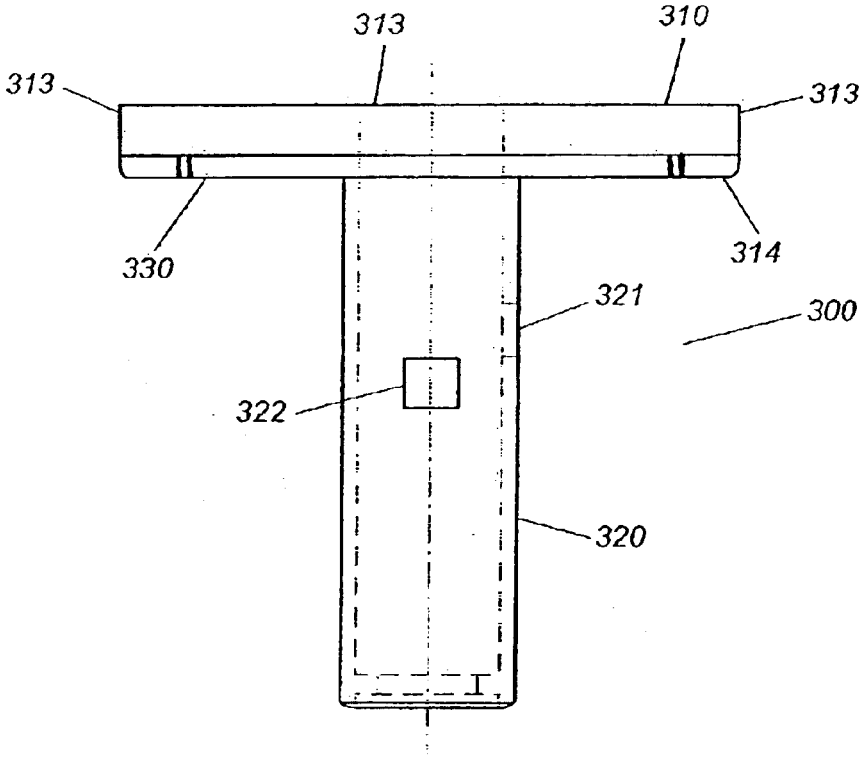
FIG. 15 shows a side view of the vandal resistant T-handle assembly of FIG. 14.

The T-handle body 320 is shown in FIG. 15, and generally includes a first or shallow locking bolt element passage 321 and a second or deep locking bolt element passage 322. The T-handle body 320 further includes a threaded lock stud passage 323 for accommodating a threaded lock stud enabling rotation of the T-handle assembly 300 into a recessed, locked position within the door of a vending machine or a similar enclosure.

Figure 16:
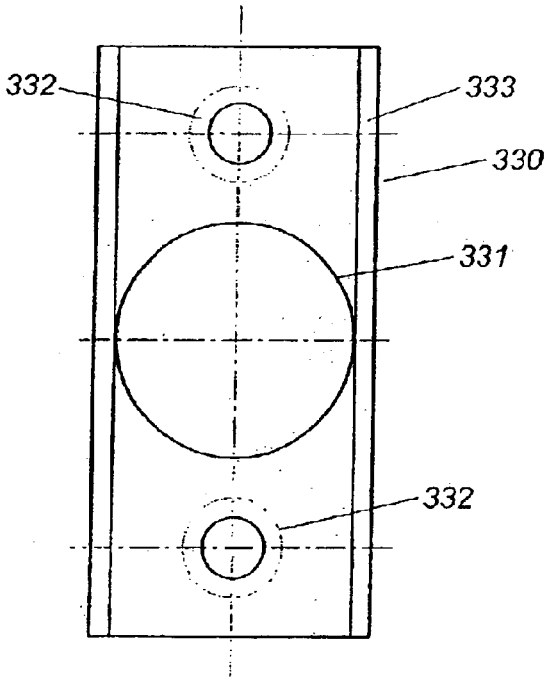
FIG. 16 shows a back plate of the vandal resistant T-handle assembly of FIG. 14.

FIGS. 15 and 16 show the back plate 330 of the T-handle assembly 300. As with the back plates of the previous embodiments, back plate 330 preferably is constructed of a high strength, tamper resistant, hardened, drill resistant metal material, such as steel, but may also be constructed from other, similar materials, including composites, having a comparable high strength and hardness. The back plate 330 generally is coupled to the rear face 314 of the face element 310, and includes a T-handle body passage 331 and mounting holes 332 for coupling the back plate 330 to the rear face 314 of face element 310. The back plate 330 further includes rounded edge stiffeners 333 to reinforce the periphery of the face element and to resist bending of the back plate.

The T-handle assembly 300 is assembled for use in a T-handle locking assembly in the same manner as T-handle assemblies 100 and 200 are assembled. That is, the T-handle assembly 300 is assembled by coupling the back plate 330 to the face element 310. More specifically, T-handle assembly 300 is assembled by coupling or mounting the back plate 330 to the rear face 314 of face element 310 as shown in FIG. 15. As with the previous embodiments, this attachment typically is accomplished by first passing the T-handle body 320 through the T-handle body passage 331 of the back plate 330, and then aligning and arranging the mounting holes 332 over the protrusions 315. Thereafter, the back plate 330 is mated to the rear face 314 by aligning the back plate 330 within the recessed area 318 of the rear face 314 and engaging the ledges 319 and recessed portions 318 of the face element 310 with the edge stiffeners 333 of back plate 330. Thereafter, the back plate 330 generally is secured to the rear face 314 by urging or moving the protrusions 315 down over the mounting holes 332 using a spinner tool or other suitable tool.

Figure 14A:
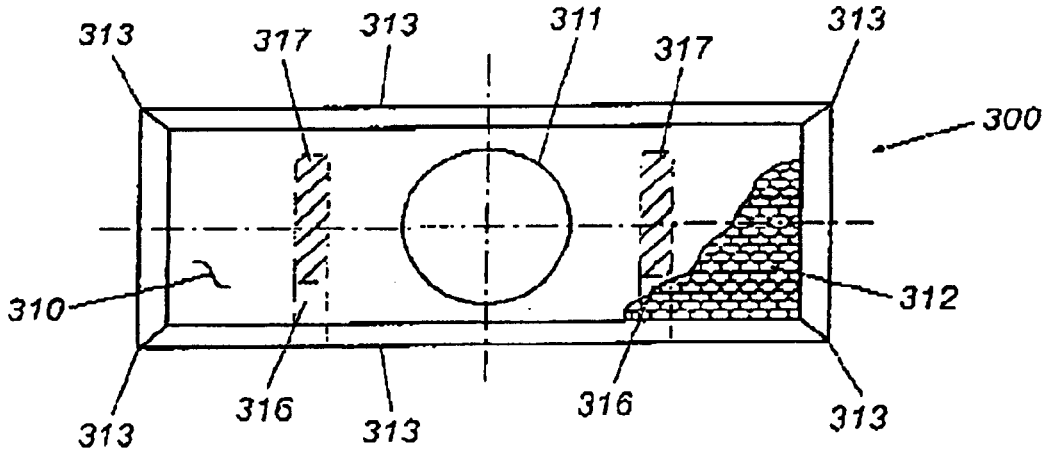
FIG. 14*a* shows a front view of the vandal resistant T-handle assembly of FIG. 14 including optional drill resistant pins.

As shown in FIG. 14*a*, the face element 310 optionally includes drill resistant pins 317 in front of and obstructing access to the protrusions 315. To allow for the inclusion of the pins 317, blind pin holes 316 are provided in the face element 310. Again, the pin holes 316 may be east into face element 310, or they may be drilled into the face element 310 after casting the face element 310. The drill resistant pins 317 are inserted into the blind pin holes 316, as is done with the previous embodiments.

The T-handle assembly 300 comprises square outer edges and is therefore not as effective against puller tools as is T-handle assembly 100. However, the square outer edges 313 of T-handle assembly 300, like the beveled edges of T-handle assembly 200, can meet the different appearance needs of a particular user.

The present invention thus provides an improved T-handle assembly for use in locking assemblies for securing vending machines or other enclosures, which is designed to resist drilling and strikes by high-impact tools. According to one embodiment of the invention, the improved T-handle assembly includes rounded face edges that resist gripping by puller tools. The further use of drill resistant pins helps prevent vandals and thieves from drilling out the protrusions that couple the back plate to the rear face of the face element. The T-handle assembly of the present invention therefore provides a cost-effective solution for resisting the attempts of thieves and vandals to gain unauthorized access to vending machines by drilling, battering or pulling the T-handle assembly.

Figure 18:
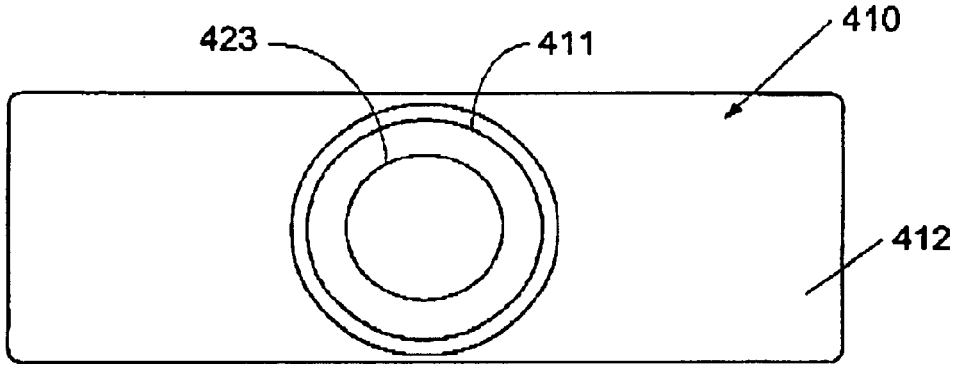
FIG. 18 shows a face view of the T-handle assembly in another embodiment of the invention.
Figure 19:
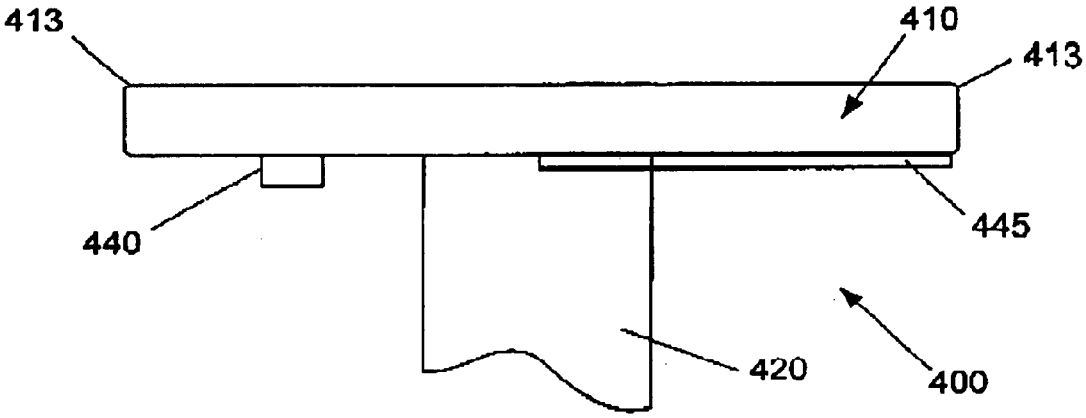
FIG. 19 shows a side view of the T-handle assembly of FIG. 18, including a retainer stud and slot fillers.
Figure 18A:
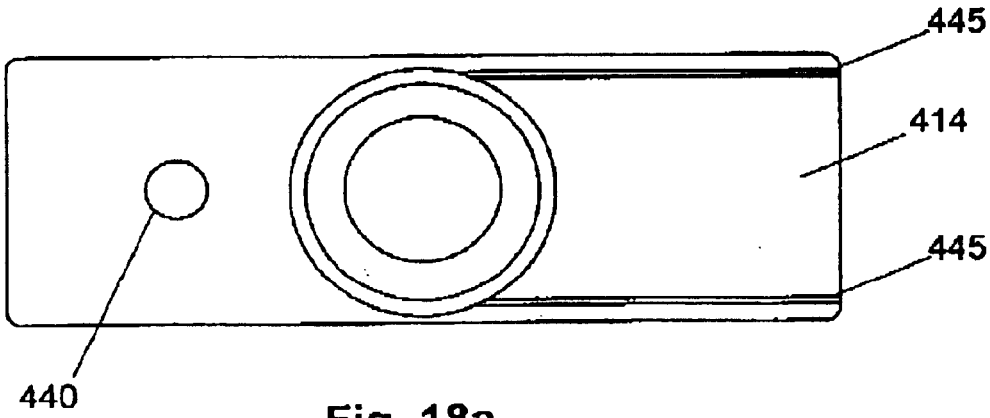
FIG. 18*a* shows a rear view of the T-handle assembly of FIG. 18.

Another embodiment of the vandal-resistant T-handle assembly 400 of the invention is shown in FIGS. 18–23. The T-handle assembly 400 includes a face element 410 and a T-handle body 420 in similar fashion to the embodiment of the T-handle assembly 100 generally shown in FIGS. 3–9. As shown in FIGS. 18, 18A, and 19, the face element 410 of T-handle assembly 400 generally includes a lock passage 411, a front face or first surface 412 having rounded edges 413, and a rear face or second surface 414 with a retainer stud 440 and slot fillers 445. The slot fillers 445 extend along the top and bottom extremities of the rear face 414 and are opposite the retainer stud 440. The retainer stud 440 and slot fillers 445 are provided for securing a hardened sleeve 450 to the face element 410 as described and shown below with reference to FIGS. 22–23.

The T-handle body 420 is shown in FIG. 19 and generally includes substantially the same or similar features as the T-handle body 120, 220, or 320 shown in the previous embodiments. The T-handle body 420 can further include a threaded lock passage 423 as indicated in FIG. 18 for accommodating a threaded locking stud that enables rotation of the T-handle assembly 400 into a recessed, locked position within the door of a vending machine or similar enclosure.

Figure 20:
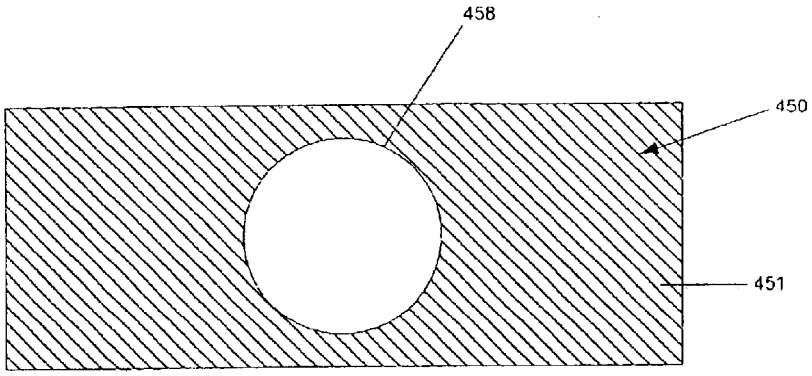
FIG. 20 shows a face view of a hardened sleeve.
Figure 21:
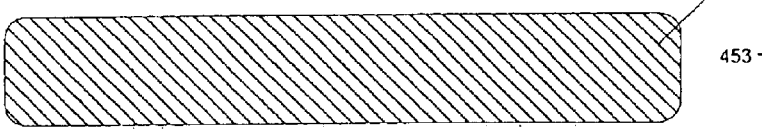
FIG. 21 shows a side view of the hardened sleeve of FIG. 20.
Figure 20A:
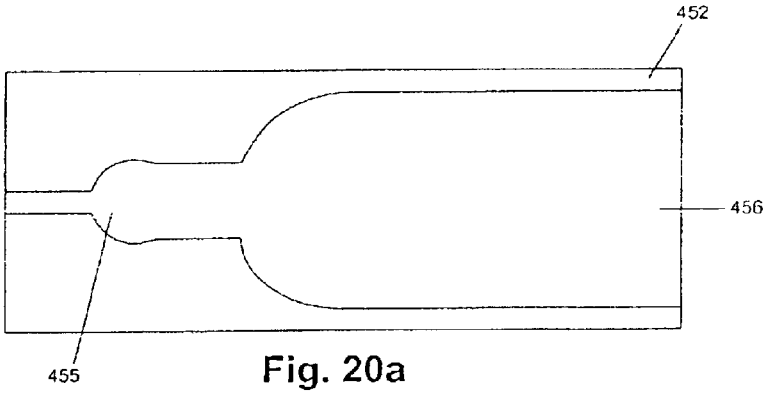
FIG. 20*a* shows a rear view of the hardened sleeve of FIG. 20.

As shown in FIGS. 20–21, the hardened sleeve 450 is provided to enhance the vandal-resistant T-handle assembly in this embodiment. As shown in FIG. 20, hardened sleeve 450 includes a top surface 451 and a lock passage opening or access 458 to accommodate lock passage 411. Hardened sleeve 450 also includes opposing side surfaces 453 (FIG. 21) and bottom surface 452 (FIG. 20A). Similar to the back plate of the previous embodiments, the hardened sleeve 450 is preferably constructed of a high strength, tamper resistant, hardened, drill resistant metal material, such as steel, but may also be constructed from similar materials, including composites, having a comparable high strength and hardness.

Figure 21A:
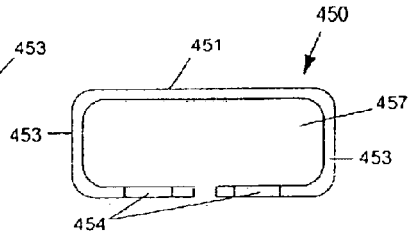
Figure 22:
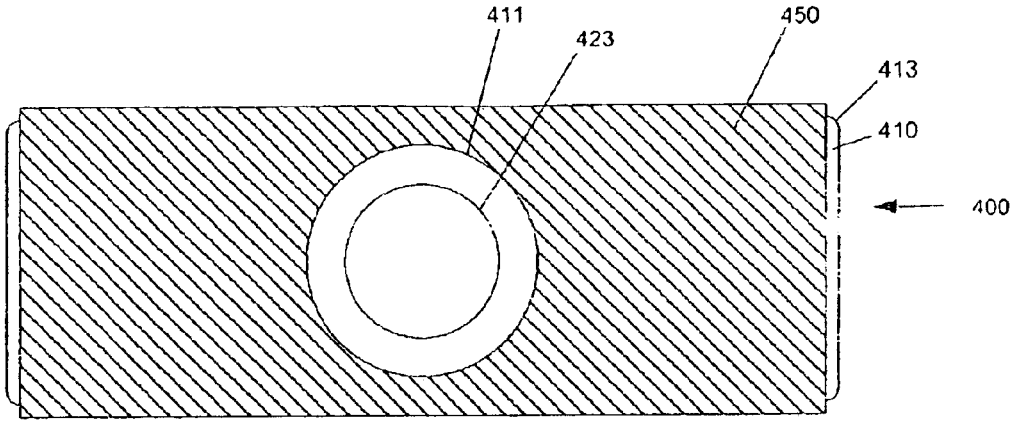
FIG. 22 shows a face view of the hardened sleeve coupled to the T-Handle Assembly.

The hardened sleeve 450 is assembled with the T-handle core 400 by sliding the hardened sleeve 450 over the T-handle face element 410 and retainer stud 440. Specifically, the hardened sleeve,450 includes a handle slot 456 as shown in FIG. 20A and a face element slot 457 as shown in FIG. 21A which receives face element 410 as shown in FIG. 22 and FIG. 23A. To facilitate a secure assembly, the hardened sleeve 450 is slotted to enable the handle slot to receive T-handle Face Element 410 and further allow attachment recess 455 to receive retainer stud 440. During assembly of the T-handle and sleeve 450, face element 410 is received in the face element slot 457 and the slot fillers 445 are received in the assembly slots 454, while the Face Element 410 is received within the handle slot 456, and the retainer stud 440 is received within the attachment recess 455.

Figure 22A:
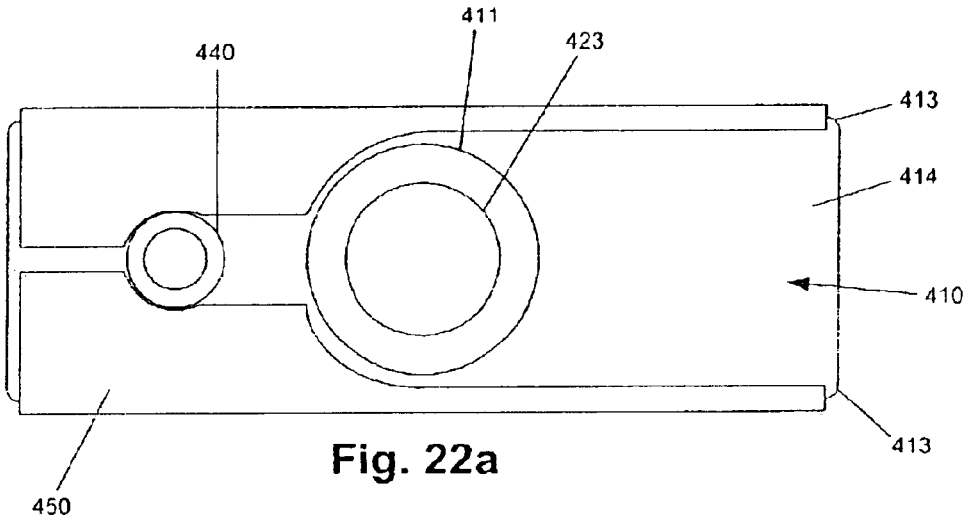
FIG. 22*a* shows a rear view of the hardened sleeve coupled to the T-Handle Assembly.
Figure 23:
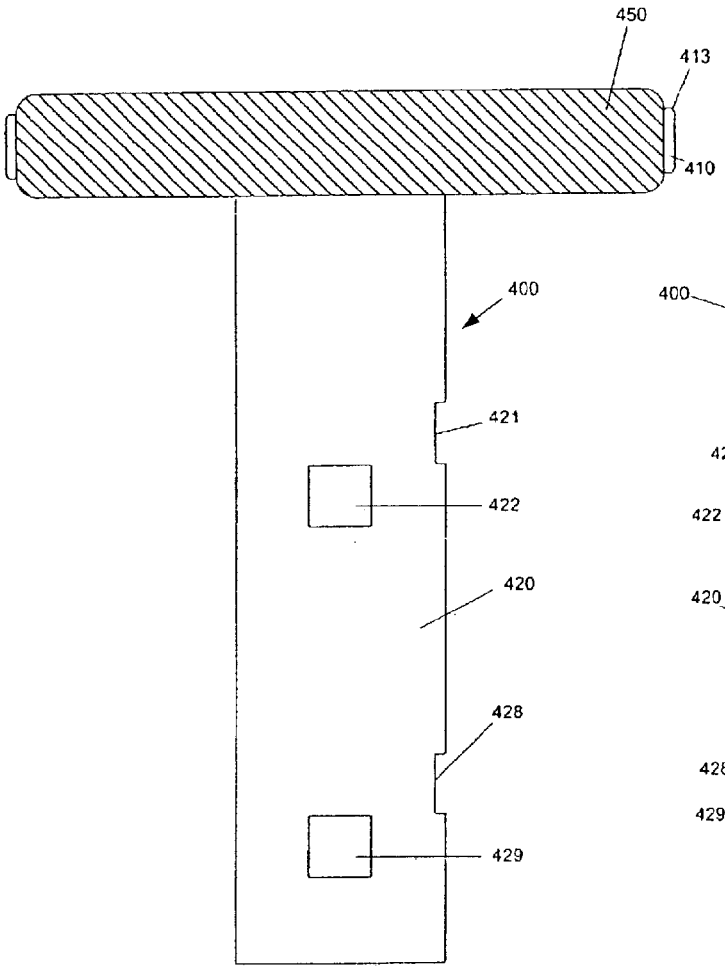
FIG. 23 shows a side view of the hardened sleeve coupled to the T-Handle Assembly with added lock holes.
Figure 23A:
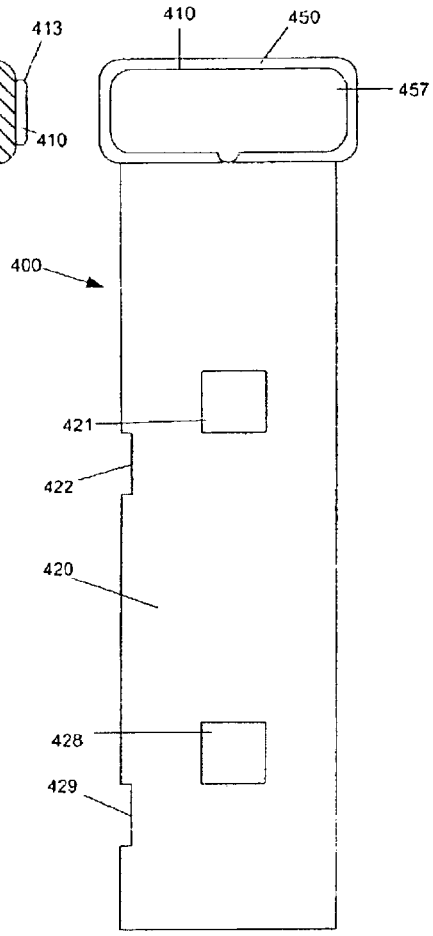
FIG. 23*a* shows an edge view of the hardened sleeve coupled to the T-Handle Assembly with added lock holes.

Upon complete assembly of the hardened sleeve 450 onto the T-handle assembly 400, the hardened sleeve will be attached as shown in FIGS. 22A and 23. Additionally, upon complete assembly of the hardened sleeve onto the T-handle core, the lock passage opening 458 will be aligned with the lock passage 411 to enable an opening device to be inserted into and engage the lock of the T-handle to lock or unlock the T-handle assembly as desired. The retainer stud 440, in cooperation with the slot fillers 445, further maintains the assembly of the component parts for positive retention thereof.

As shown in FIGS. 23 and 23A, this embodiment of the T-handle assembly 400 also includes additional lock holes 428 and 429 generally located at the base of the T-handle body 420. The T-handle body 420 further includes a first or shallow locking bolt element passage 421 and a second or deep locking bolt passage 422 aligned with the lock holes 428 and 429, which thus provides additional locking element passages for increased security and to enable the T-handle assembly to be used with electronic locking devices. Additionally, although not shown in the figures, this embodiment can be supplemented with any of the additional measures as described above, including drill-resistant pins, etc., to further enhance security of the T-handle assembly.

It will be understood by those skilled in the art that while the foregoing invention has been disclosed with reference to preferred embodiments or features, various modifications, changes and additions can be made to the foregoing invention without departing from the spirit and scope of the invention as set forth in the following claims.

What is claimed:

1. A T-handle locking assembly for securing an enclosure comprising:

a T-handle body having a tubular body and a face element;

a sleeve releasably coupled to the face element of T-handle body, wherein the sleeve is formed from a hardened material to resist tampering;

the face element comprises a front face and a rear face; and, the rear face includes a retainer stud and slot fillers;

wherein the sleeve comprises a face element slot that receives the face element, a handle slot that receives the T-handle body, an attachment recess that receives the retainer stud, and assembly slots that receive the slot fillers.

2. A method of assembling a T-handle housing assembly for securing a vending machine, the T-handle housing assembly comprising a tubular body and a face element, the face element including a front free and a rear face, the rear face including a retainer stud and slot fillers, the method comprising:

applying a hardened material sleeve over the front face of the face element to engage the retainer stud on the rear face, wherein the sleeve comprises a face element slot for receipt of the face element, a handle slot for receipt of the tubular body, an attachment recess for receipt of the retainer stud, and assembly slots for receipt of the slot fillers, and positioning the T-handle housing assembly within a T-handle locking assembly.

3. The method of claim 2, wherein the face element and the tubular body are constructed of a castable material.

4. The method of claim 2, wherein the hardened sleeve is constructed of a hardened, high strength metal material.

5. The method of claim 2, wherein at least one lock hole is provided proximate the front face.

6. The method of claim 2, wherein the T-handle body includes a tubular body and wherein at least one lock hole is provided proximate a terminus of the tubular body.

7. A method of assembling a T-handle locking assembly for securing a vending machine, the T-handle locking assembly comprising a tubular body and a face element, the face element including a front face and a rear face, the rear face including a retainer study and slot fillers, comprising:

applying a hardened material sleeve over the front face of the face element to engage the rear face, wherein the sleeve comprises a face element slot for receipt of the face element, a handle slot for receipt of the tubular body, an attachment recess for receipt of the retainer stud, and assembly slots for receipt of the slot fillers, and positioning the T-handle locking assembly within a T-handle housing assembly.

8. The method of claim 7, wherein the face element and the tubular body are constructed of a castable material.

9. The method of claim 7, wherein the hardened sleeve is constructed of a hardened, high strength metal material.

10. The method of claim 7, wherein at least one lock hole is provided proximate the front face.

11. The method of claim 7, wherein at least one lock hole is provided proximate a terminus of the tubular body.

* * * * *